US009289670B2

(12) United States Patent
Balardeta et al.

(10) Patent No.: US 9,289,670 B2
(45) Date of Patent: Mar. 22, 2016

(54) METHOD AND SYSTEM FOR POWER CONSERVATION OF A RF DEVICE DURING SHIPPING

(75) Inventors: Joseph Balardeta, Encinitas, CA (US); Scott Denton, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 1213 days.

(21) Appl. No.: 13/100,162

(22) Filed: May 3, 2011

(65) Prior Publication Data

US 2012/0015752 A1 Jan. 19, 2012

Related U.S. Application Data

(63) Continuation of application No. 12/838,656, filed on Jul. 19, 2010, now abandoned.

(51) Int. Cl.

| | |
|---|---|
| ***A63F 9/24*** | (2006.01) |
| ***A63F 13/00*** | (2014.01) |
| ***G06F 17/00*** | (2006.01) |
| ***G06F 19/00*** | (2011.01) |
| ***A63B 69/36*** | (2006.01) |
| ***A63B 24/00*** | (2006.01) |

(52) U.S. Cl.

CPC ..... *A63B 69/3658* (2013.01); *A63B 24/0021* (2013.01); *A63B 2024/0031* (2013.01); *A63B 2220/12* (2013.01); *A63B 2220/14* (2013.01); *A63B 2225/54* (2013.01)

(58) Field of Classification Search

CPC ..... A63B 69/3658; A63B 24/0021; A63B 225/54; A63B 2220/14; A63B 220/12; A63B 2024/0031

USPC ..... 463/39; 473/131, 136

See application file for complete search history.

(56) References Cited

U.S. PATENT DOCUMENTS

| | | | | |
|---|---|---|---|---|
| 3,182,508 | A | 5/1965 | Varju | |
| 3,792,863 | A | 2/1974 | Evans | |
| 4,759,219 | A | 7/1988 | Cobb et al. | |
| 4,991,850 | A | 2/1991 | Wilhlem | |
| 5,233,544 | A | 8/1993 | Kobayashi | |
| 5,694,340 | A | 12/1997 | Kim | |
| 6,224,493 | B1 | 5/2001 | Lee et al. | |
| 6,402,634 | B2 | 6/2002 | Lee et al. | |
| 6,431,990 | B1 | 8/2002 | Manwaring | |
| 6,638,175 | B2 | 10/2003 | Lee et al. | |
| 6,821,209 | B2 | 11/2004 | Manwaring et al. | |
| 7,163,468 | B2 | 1/2007 | Gibbs et al. | |
| 7,163,470 | B2 | 1/2007 | Galloway et al. | |
| 7,166,038 | B2 | 1/2007 | Williams et al. | |
| 7,214,143 | B2 | 5/2007 | Deshmukh | |
| 7,252,600 | B2 | 8/2007 | Murphy et al. | |
| 7,258,626 | B2 | 8/2007 | Gibbs et al. | |
| 7,258,631 | B2 | 8/2007 | Galloway et al. | |
| 7,273,419 | B2 | 9/2007 | Evans et al. | |
| 7,413,250 | B2 | 8/2008 | Connolly et al. | |
| 2006/0199670 | A1 * | 9/2006 | Town | A63B 69/0002 473/417 |
| 2009/0075761 | A1 | 3/2009 | Balardeta | |
| 2010/0144456 | A1 * | 6/2010 | Ahern | A63B 57/00 473/222 |

* cited by examiner

*Primary Examiner* — Omkar Deodhar
*Assistant Examiner* — Wei Lee
(74) *Attorney, Agent, or Firm* — Michael A. Catania; Sonia Lari; Rebecca Hanovice

(57) ABSTRACT

The present invention relates to a method for conserving battery power during shipping for an impact activated device for transmitting a radiofrequency signal. The method comprises forming an impact activated device for transmitting a radiofrequency signal. The shot tracking device is shipped in commerce and received at a retailer. The shot tracking device is stored at the retailer, wherein the battery has at least 90% of its capacity until paired with a receiver.

14 Claims, 5 Drawing Sheets

METHOD AND SYSTEM FOR POWER CONSERVATION OF A RF DEVICE DURING SHIPPING

CROSS REFERENCES TO RELATED APPLICATIONS

The present application is a continuation in part of U.S. patent application Ser. No. 12/838,656 filed on Jul. 19, 2010.

STATEMENT REGARDING FEDERALLY SPONSORED RESEARCH OR DEVELOPMENT

Not Applicable

BACKGROUND OF THE INVENTION

1. Field of the Invention

The present invention relates to power conservation. More specifically, the present invention relates to a method and system for power conservation of a radiofrequency device during shipping.

2. Description of the Related Art

Golf clubs combine with the players swing to propel a ball toward a favored location and through a favored path. The orientation and speed of the club head at impact largely determines the ball path including carry distance and roll.

The prior art is lacking in a method and system to conserve power for a radiofrequency device during shipping.

BRIEF SUMMARY OF THE INVENTION

The present invention is novel in that the observation of the relative motion does not depend on near visible light and uses a coherent pattern to capture the position of the club relative the ground antenna transmitter/receiver. This fixed device also includes a display, computing capability and recording device. This information, when processed, enables the display of the swing and uses data on the club head and ball to calculate the flight of the ball.

This invention is a shot tracking device for attachment to a golf club for tracking a golfer's round of golf. The shot tracking device comprises a battery having no more than 225 milli-amp hours of power, a microprocessor in electrical communication with the battery, wherein the microprocessor operates during a sleep mode, a sampling mode, an analysis mode, a monitoring mode and a transmission mode. The device further comprises a radiofrequency component in electrical communication with the microprocessor, wherein the radiofrequency component is only operable during a transmission mode. The shot tracking device only operates in the sleep mode and the sampling mode until the shot tracking device is paired with a receiver.

The invention further comprises a method for conserving battery power during shipping for an impact activated device for transmitting a radiofrequency signal. The method comprises forming an impact activated device for transmitting a radiofrequency signal. The device comprises a battery having no more than 225 milli-amp hours of power, a microprocessor in electrical communication with the battery wherein the microprocessor operates only during a sleep mode, a sampling mode, an analysis mode, a monitoring mode and a transmission mode. The device further comprises a motion activated component and a radiofrequency component in electrical communication with the microprocessor, wherein the radiofrequency component is only operable during a transmission mode. The shot tracking device only operates in the sleep mode and the sampling mode until the shot tracking device is paired with a receiver. The shot tracking device is shipped in commerce and received at a retailer. The shot tracking device is stored at the retailer, wherein the battery has at least 90% of its capacity until paired with a receiver.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
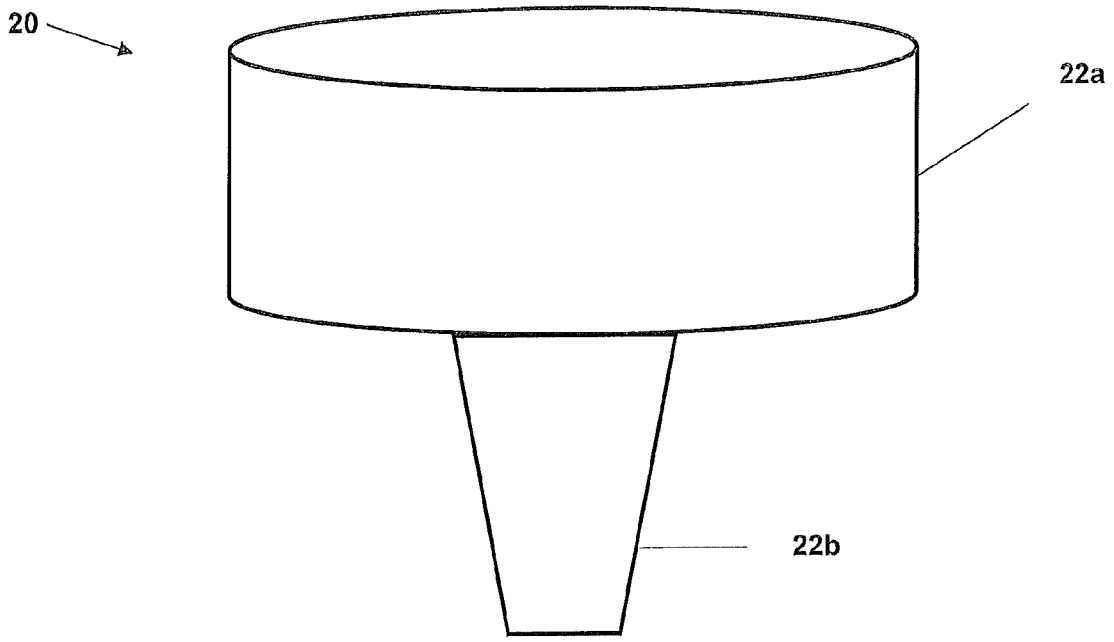
FIG. 1 is a perspective view of the device for shot tracking.

FIG. 1 is a perspective view of the device for shot tracking.

Figure 2:
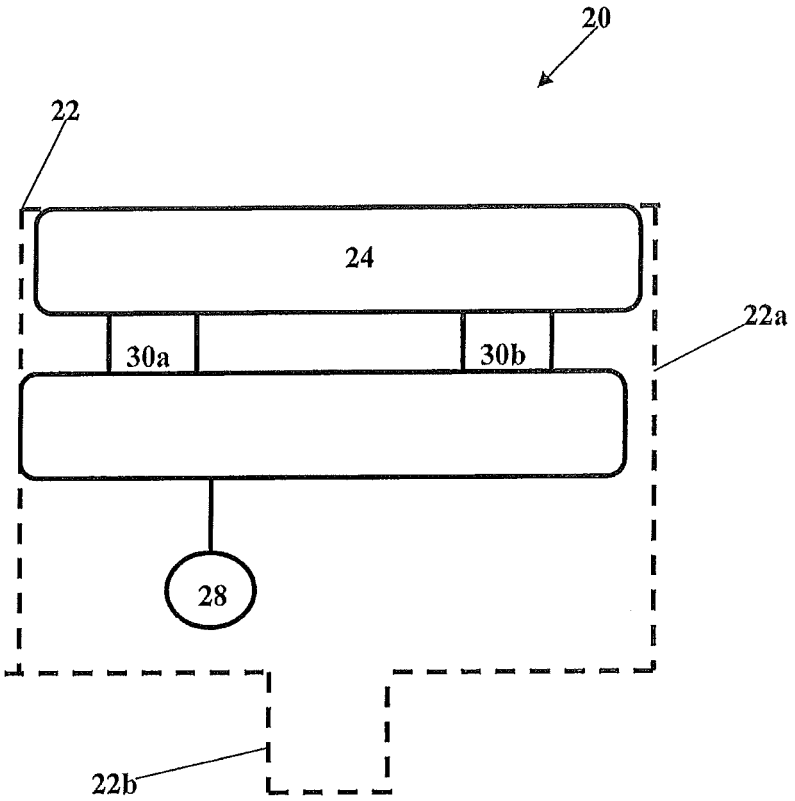
FIG. 2 is a perspective view of components of a device for shot tracking, including the main body and projection body extending downward.

FIG. 2 is a perspective view of components of a device for shot tracking, including the main body and projection body extending downward.

Figure 3:
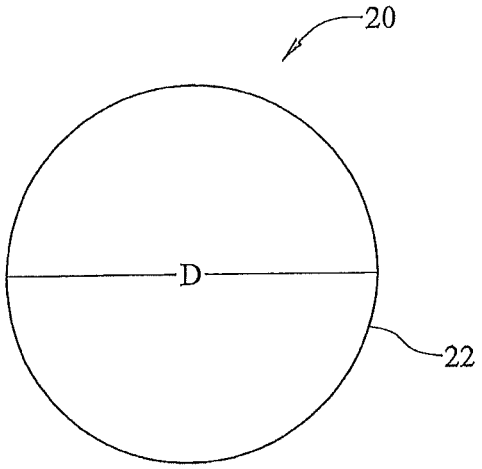
FIG. 3 shows the housing component of the shot tracking device and illustrates the diameter

FIG. 3 shows the housing component of the shot tracking device and illustrates the diameter.

Figure 4:
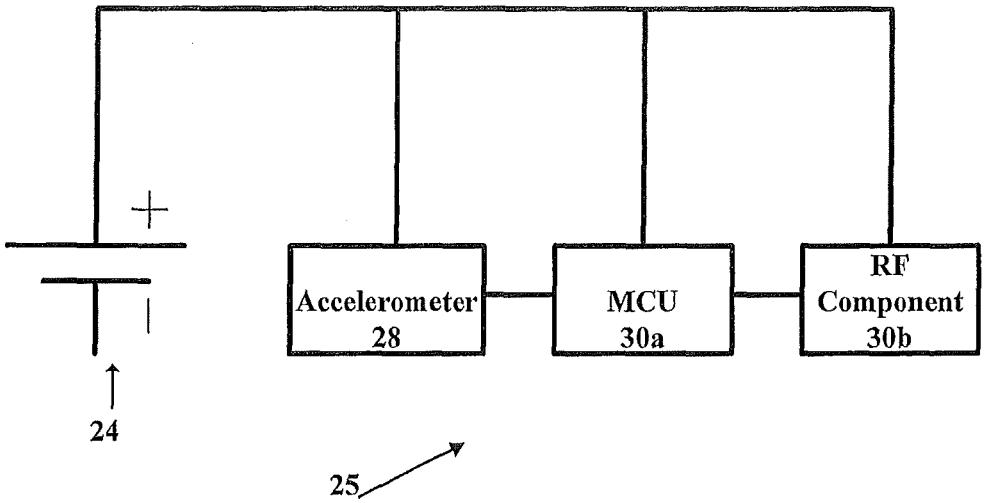
FIG. 4 is an illustration of the circuit diagram of the components of a device for shot tracking.

FIG. 4 is an illustration of the circuit diagram of the components of a device for shot tracking.

Figure 5:
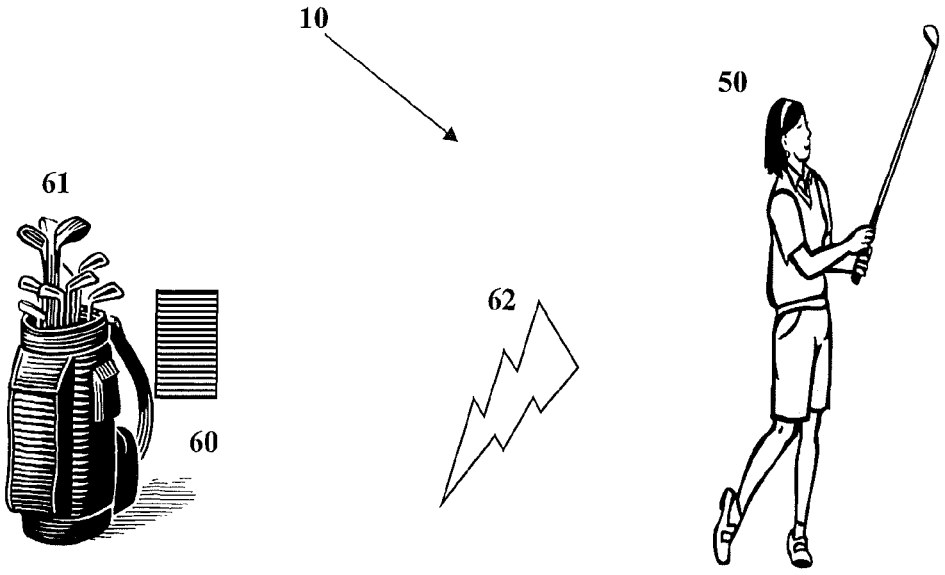
FIG. 5 is an illustration of a system for shot tracking.

FIG. 5 illustrates the system 10. A transponder in a golf club 50 swung by a golfer sends a signal 62 to a receiver 60. The receiver is attached to a golf bag 61, however, those skilled within the pertinent art will recognize that the receiver may be attached to any pertinent device including the golfer, or may stand alone.

This invention is a shot tracking device 20 for attachment to a golf club 50 for tracking a golfer's round of golf. The shot tracking device 20 comprises a battery 24 having no more than 225 milli-amp hours of power, a microprocessor 30*a* in electrical communication with the battery 24, wherein the microprocessor 30*a* operates during a sleep mode, a sampling mode, an analysis mode, a monitoring mode and a transmission mode, and a radiofrequency component 30*b* in electrical communication with the microprocessor 30*a*, wherein the radiofrequency component 30*b* is only operable during a transmission mode. The shot tracking device only operates in the sleep mode and the sampling mode until the shot tracking device is paired with a receiver 60.

Preferably, the shot tracking device 20 further comprises a multi-axis accelerometer 28 for determining movement, monitoring movement and communicating the movement to the microprocessor 30*a*. The multi-axis accelerometer 28 is in electrical communication with the microprocessor 30*b*, wherein the power for the multi-axis accelerometer 28 is drawn from the battery 24. The multi-axis accelerometer 28 is only active during the sampling mode, the analysis mode and the monitoring mode.

Additionally, the shot tracking device 20 preferably consumes less than 600 nano-amps during the sleep mode, wherein the sleep mode has a time period ranging from 10 seconds to 30 seconds. Further, the shot tracking device 20 preferably consumes less than 15 micro-amps during the sampling mode, less than 50 micro-amps during the analysis mode, less than 200 micro-amps during the monitoring mode, and less than 12 milli-amps during the transmission mode.

The radiofrequency component 30*b* operates at 2.4 giga-Hertz, the power for the radiofrequency component 30*b* being drawn from the battery 24. The device 20 comprises a housing 22 composed of a polymer material, the housing having a main body 22*a* and a projection body 22*b* extending from the main body 22*a*, the projection body 22*b* having a length ranging from 1 mm to 5 mm and a diameter ranging from 20 mm to 25 mm.

Preferably, a signal 62 is transmitted from the radiofrequency component 30*b* during the transmission mode, wherein the signal 62 comprises data related to the movement monitored by the multi-axis accelerometer 28.

The invention further comprises a method for conserving battery power during shipping for an impact activated device for transmitting a radiofrequency signal 62. The method comprises forming an impact activated device 20 for transmitting a radiofrequency signal 62. The device 20 comprises a battery 24 having no more than 225 milli-amp hours of power, a microprocessor 30*a* in electrical communication with the battery 24 wherein the microprocessor 30*a* operates only during a sleep mode, a sampling mode, an analysis mode, a monitoring mode and a transmission mode. The device 20 further comprises a motion activated component and a radiofrequency component 30*b* in electrical communication with the microprocessor 30*a*, wherein the radiofrequency component 30*b* is only operable during a transmission mode. The shot tracking device 20 only operates in the sleep mode and the sampling mode until the shot tracking device 20 is paired with a receiver 60. The shot tracking device 20 is shipped in commerce and received at a retailer. The shot tracking device 20 is stored at the retailer, wherein the battery 24 has at least 90% of its capacity until paired with a receiver.

Preferably, the device 20 used in the method further comprises a multi-axis accelerometer 28 for determining movement, monitoring movement and communicating the movement to the microprocessor 30*a*. The multi-axis accelerometer 28 in electrical communication with the microprocessor 30*a*, wherein the power for the multi-axis accelerometer 28 is drawn from the battery 24. The multi-axis accelerometer 28 is only active during the sampling mode, the analysis mode and the monitoring mode. The microprocessor is in electrical communication with the radiofrequency component 30*b*, wherein the radiofrequency component 30*b* operates at 2.4 giga-Hertz. The power for the radiofrequency component 30*b* being drawn from the battery 25.

The sleep mode has a time period ranging from 10 seconds to 30 seconds and the device 20 consumes less than 600 nano-amps during the sleep mode. A signal 62 is transmitted from the radiofrequency component 30*b* during the transmission mode, wherein the signal 62 comprises data related to the movement monitored by the multi-axis accelerometer 28.

The invention further comprises a method for conserving battery power during shipping for an impact activated device 20 for transmitting a radiofrequency signal 62. The method comprises forming an impact activated device for transmitting a radiofrequency signal 62. The device 20 comprises a battery 24 having no more than 225 milli-amp hours of power, a microprocessor 30*a* in electrical communication with the battery 24 wherein the microprocessor 30*a* operates only during a sleep mode, a sampling mode, an analysis mode, a monitoring mode and a transmission mode. The device 20 further comprises a motion activated component and a radiofrequency component 30*b* in electrical communication with the microprocessor 30*a*, wherein the radiofrequency component 30*b* is only operable during a transmission mode. The shot tracking device 20 only operates in the sleep mode and the sampling mode until the shot tracking device 20 is paired with a receiver 60. The shot tracking device 20 is shipped in commerce and received at a retailer. The shot tracking device 20 is stored at the retailer, wherein the battery 24 has at least 90% of its capacity until paired with a receiver 60.

Preferably, the device 20 consumes less than 600 nano-amps during the sleep mode. Additionally, the device 20 consumes less than 50 micro-amps during the analysis mode. The device consumes less than 200 micro-amps during the monitoring mode and less than 12 milli-amps during the analysis mode.

Preferably, the microprocessor 30*b* is configured to transmit data on the golfer's 40 swing in a single transmission. Alternatively, the microprocessor 30*b* is configured to transmit the data in a plurality of transmission. The microprocessor 30*b* is preferably configured to monitor the backswing and monitor the downswing at a rate of at least 1 kilo-Hertz or alternatively at a rate of at least 5 kilo-Hertz. The data for the golfer's 40 swing is transmitted at a radiofrequency of 2.4 gigaHertz utilizing the radiofrequency transceiver 30*b* of the device 20. The device 20 may further comprise a microprocessor 30*a*, battery 24 and a multiple axis accelerometer 28. The receiver 60 of the system 10 is preferably a GPS device or alternatively a Smart Phone, PDA, or computer.

In an alternative embodiment, the data of the golfer's swing is transmitted from a device 20 comprising a housing 22 composed of a polymer material, wherein the housing has a main body 22*a* and a projection body 22*b* extending from the main body 22*a* as shown in FIGS. 1-2. The projection body 22*b* has a length ranging from 1 mm to 5 mm and a diameter ranging from 20 mm to 25 mm as shown in FIG. 3. As shown in FIG. 4, a battery 24 is positioned within the housing 22 and a microprocessor 30*a* is positioned within the housing 22, wherein the microprocessor 30*a* is in electrical communication with the battery 24. The device 20 further comprises a multi-axis accelerometer 28 for determining movement, monitoring movement and communicating the movement to the microprocessor 30*a*, wherein the multi-axis accelerometer 28 positioned within the housing 22. The multi-axis accelerometer 28 is in electrical communication with the microprocessor 30*a*. A radiofrequency component 30*b* is positioned within the housing 22, wherein the radiofrequency component 30*b* in electrical communication with the microprocessor 30*a*. The radiofrequency component 30*b* operates at 2.4 giga-Hertz, and the radiofrequency component 30*b* transmits a signal 62 comprising data related to the movement monitored by the multi-axis accelerometer 28.

The battery 24 is preferably a CR1620 having at least 75 milliamps of power. The receiver is preferably a GPS device 60 such as disclosed in Balardeta et al., U.S. Patent Publication Number 20090075761 for a Golf GPS Device And System, which is hereby incorporated by reference in its entirety. Alternatively, the receiver is a personal digital assistant (PDA), "smart phone", mobile phone, or other similar device. However, those skilled in the pertinent art will recognize that the receiver may be any device capable of receiving and storing signals from the RFID tag.

Gibbs, et al., U.S. Pat. No. 7,163,468 is hereby incorporated by reference in its entirety.

Galloway, et al., U.S. Pat. No. 7,163,470 is hereby incorporated by reference in its entirety.

Williams, et al., U.S. Pat. No. 7,166,038 is hereby incorporated by reference in its entirety.

Desmukh U.S. Pat. No. 7,214,143 is hereby incorporated by reference in its entirety.

Murphy, et al., U.S. Pat. No. 7,252,600 is hereby incorporated by reference in its entirety.

Gibbs, et al., U.S. Pat. No. 7,258,626 is hereby incorporated by reference in its entirety.

Galloway, et al., U.S. Pat. No. 7,258,631 is hereby incorporated by reference in its entirety.

Evans, et al., U.S. Pat. No. 7,273,419 is hereby incorporated by reference in its entirety.

Hocknell, et al., U.S. Pat. No. 7,413,250 is hereby incorporated by reference in its entirety.

The measurements may be inputted into an impact code such as the rigid body code disclosed in U.S. Pat. No. 6,821,209, entitled Method for Predicting a Golfer's Ball Striking Performance, which is hereby incorporated by reference in its entirety.

The swing properties are preferably determined using an acquisition system such as disclosed in U.S. Pat. No. 6,431,990, entitled System and Method for Measuring a Golfer's Ball Striking Parameters, assigned to Callaway Golf Company, the assignee of the present application, and hereby incorporated by reference in its entirety. However, those skilled in the pertinent art will recognize that other acquisition systems may be used to determine the swing properties.

Other methods that are useful in obtaining a golfer's swing characteristics are disclosed in U.S. Pat. No. 6,638,175, for a Diagnostic Golf Club System, U.S. Pat. No. 6,402,634, for an Instrumented Golf Club System And Method Of Use, and U.S. Pat. No. 6,224,493, for an Instrumented Golf Club System And Method Of Use, all of which are assigned to Callaway Golf Company, the assignee of the present application, and all of which are hereby incorporated by reference in their entireties.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A method for conserving battery power during shipping for an impact activated device for transmitting a radiofrequency signal, the method comprising:

forming an impact activated device comprising a battery having no more than 225 milli-amp hours of power, a microprocessor in electrical communication with the battery, the microprocessor operating during a sleep mode, a sampling mode, an analysis mode, a monitoring mode and a transmission mode, a motion activation component, and a radiofrequency component in electrical communication with the microprocessor, the radiofrequency component only operable during a transmission mode, wherein the shot tracking device only operates in the sleep mode and the sampling mode until the shot tracking device is paired with a receiver;

shipping the shot tracking device in commerce;

receiving the shot tracking device at a retailer; and storing the shot tracking device at the retailer, wherein the battery has at least 90% of its capacity until paired with a receiver.

2. The method for conserving battery power according to claim 1 wherein the device further comprises a multi-axis accelerometer for determining movement, monitoring movement and communicating the movement to the microprocessor, the multi-axis accelerometer in electrical communication with the microprocessor, the power for the multi-axis accelerometer drawn from the battery, the multi-axis accelerometer only active during the sampling mode, the analysis mode and the monitoring mode.

3. The method for conserving battery power according to claim 1 wherein the device comprises a housing composed of a polymer material, the housing having a main body and a projection body extending from the main body, the projection body having a length ranging from 1 mm to 5 mm and a diameter ranging from 20 mm to 25 mm.

4. The method for conserving battery power according to claim 1 wherein the radiofrequency component operates at 2.4 giga-Hertz, the power for the radiofrequency component being drawn from the battery.

5. The method for conserving battery power according to claim 1 wherein the sleep mode has a time period ranging from 10 seconds to 30 seconds.

6. The method for conserving battery power according to claim 1 wherein the device consumes less than 600 nanoamps during the sleep mode.

7. The method for conserving battery power according to claim 2 wherein a signal is transmitted from the radiofrequency component during the transmission mode, the signal comprising data related to the movement monitored by the multi-axis accelerometer.

8. A method for conserving battery power during shipping for an impact activated device for transmitting a radiofrequency signal, the method comprising:

forming an impact activated device comprising a housing composed of a polymer material, the housing having a main body and a projection body extending from the main body, the projection body having a length ranging from 1 mm to 5 mm and a diameter ranging from 20 mm to 25 mm, a battery having no more than 225 milli-amp hours of power, a microprocessor in electrical communication with the battery, the microprocessor operating during a sleep mode, a sampling mode, an analysis mode, a monitoring mode and a transmission mode, the sleep mode having a time period ranging from 10 seconds to 30 seconds, a motion activation component, and a radiofrequency component in electrical communication with the microprocessor, the radiofrequency component only operable during a transmission mode, wherein the shot tracking device only operates in the sleep mode and the sampling mode until the shot tracking device is paired with a receiver;

shipping the shot tracking device in commerce;

receiving the shot tracking device at a retailer; and storing the shot tracking device at the retailer, wherein the battery has at least 90% of its capacity until paired with a receiver.

9. The method for conserving battery power according to claim 8 wherein the device consumes less than 600 nanoamps during the sleep mode.

10. The method for conserving battery power according to claim 8 wherein the device consumes less than 50 micro-amps during the analysis mode.

11. The method for conserving battery power according to claim 8 wherein the device consumes less than 200 micro-amps during the monitoring mode.

12. The method for conserving battery power according to claim 8 wherein the device consumes less than 12 milli-amps during the analysis mode.

13. The method for conserving battery power according to claim 8 wherein the radiofrequency component operates at 2.4 giga-Hertz, the power for the radiofrequency component being drawn from the battery.

14. The method for conserving battery power according to claim 8 wherein the device further comprises a multi-axis accelerometer for determining movement, monitoring movement and communicating the movement to the microprocessor, the multi-axis accelerometer in electrical communication with the microprocessor, the power for the multi-axis accelerometer drawn from the battery, the multi-axis accelerometer only active during the sampling mode, the analysis mode and the monitoring mode.

* * * * *